US010822901B2

(12) United States Patent
Xu et al.

(10) Patent No.: US 10,822,901 B2
(45) Date of Patent: Nov. 3, 2020

(54) OBJECT SEAT AND METHOD

(71) Applicants: YingQing Xu, Tomball, TX (US); Michael Johnson, Katy, TX (US); Matthew Stone, Humble, TX (US); Colin Andrew, Cypress, TX (US); Zhiyue Xu, Cypress, TX (US)

(72) Inventors: YingQing Xu, Tomball, TX (US); Michael Johnson, Katy, TX (US); Matthew Stone, Humble, TX (US); Colin Andrew, Cypress, TX (US); Zhiyue Xu, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 130 days.

(21) Appl. No.: 16/047,923

(22) Filed: Jul. 27, 2018

(65) Prior Publication Data

US 2020/0032600 A1 Jan. 30, 2020

(51) Int. Cl.

| | |
|---|---|
| ***E21B 23/04*** | (2006.01) |
| ***E21B 34/14*** | (2006.01) |
| ***E21B 34/08*** | (2006.01) |

(52) U.S. Cl.

CPC ..... *E21B 23/0413* (2020.05); *E21B 34/08* (2013.01); *E21B 34/142* (2020.05)

(58) Field of Classification Search

CPC ..... E21B 34/14; E21B 23/0413; E21B 23/04; E21B 34/142; E21B 34/08

See application file for complete search history.

(56) References Cited

U.S. PATENT DOCUMENTS

| | | | | |
|---|---|---|---|---|
| 3,419,081 | A * | 12/1968 | Nelson | E21B 21/103 166/328 |
| 2004/0045723 | A1* | 3/2004 | Slup | E21B 33/1204 166/386 |
| 2010/0025120 | A1* | 2/2010 | Warren | E21B 10/64 175/402 |
| 2010/0252280 | A1* | 10/2010 | Swor | E21B 34/14 166/386 |
| 2016/0084040 | A1* | 3/2016 | Brasseaux | E21B 34/10 166/374 |

* cited by examiner

*Primary Examiner* — D. Andrews
(74) *Attorney, Agent, or Firm* — Cantor Colburn LLP

(57) ABSTRACT

An object seat including a seat host having a seal bore therein, a seat body dimensioned to be receivable in the seal bore, the seat body having an object receptor. A method for carrying out a pressure operation in a borehole including seating an object on an object receptor of a seat body, the seat body disposed in a seat host, the seat host disposed in the borehole, pressuring against the object, and moving the seat body along an interface between the seat body and the seat host to create a fluid flow pathway through the seat body and seat host interface. A borehole system including a borehole in a formation, an object seat as in any prior embodiment disposed in the borehole.

16 Claims, 4 Drawing Sheets

OBJECT SEAT AND METHOD

BACKGROUND

In the resource recovery industry, pressure differentials are often used to carry out operations in a borehole. Seats are installed in the borehole to receive an object thereon to create a near sealed condition so that pressure applied against the object while on the seat is substantially contained and hence can be increased. In some cases, quite high differential pressures are applied against the object and seat such that the object might become stuck in the seat. This condition is undesirable because a flow path through the borehole is eliminated by the condition. Normally it would be expected that the object would be moved off seat using fluid flow in a direction opposite that which seated the object in the first place. Obviously if the object has become stick, fluid flow may be insufficient to unseat the object.

With fracturing being a regular part of well development or reconditioning, objects becoming stuck in their seats has become an increasing problem due to the pressures at which fracturing is undertaken. The art would well receive alternative technologies that alleviate the issues associated with stuck objects.

SUMMARY

An object seat including a seat host having a seal bore therein, a seat body dimensioned to be receivable in the seal bore, the seat body having an object receptor.

A method for carrying out a pressure operation in a borehole including seating an object on an object receptor of a seat body, the seat body disposed in a seat host, the seat host disposed in the borehole, pressuring against the object, and moving the seat body along an interface between the seat body and the seat host to create a fluid flow pathway through the seat body and seat host interface.

A borehole system including a borehole in a formation, an object seat as in any prior embodiment disposed in the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The above noted drawbacks related to stuck objects are overcome by the configurations disclosed herein. Each of the configurations disclosed allows a portion of an object seat to be ejected from the balance of the seat. The two portions are initially sealed together so that pressure may be held and yet may be easily separated using a pressure differential in the opposite direction to that used for the initial operation (i.e. opposite the direction in which the object became stuck).

Figure 1:
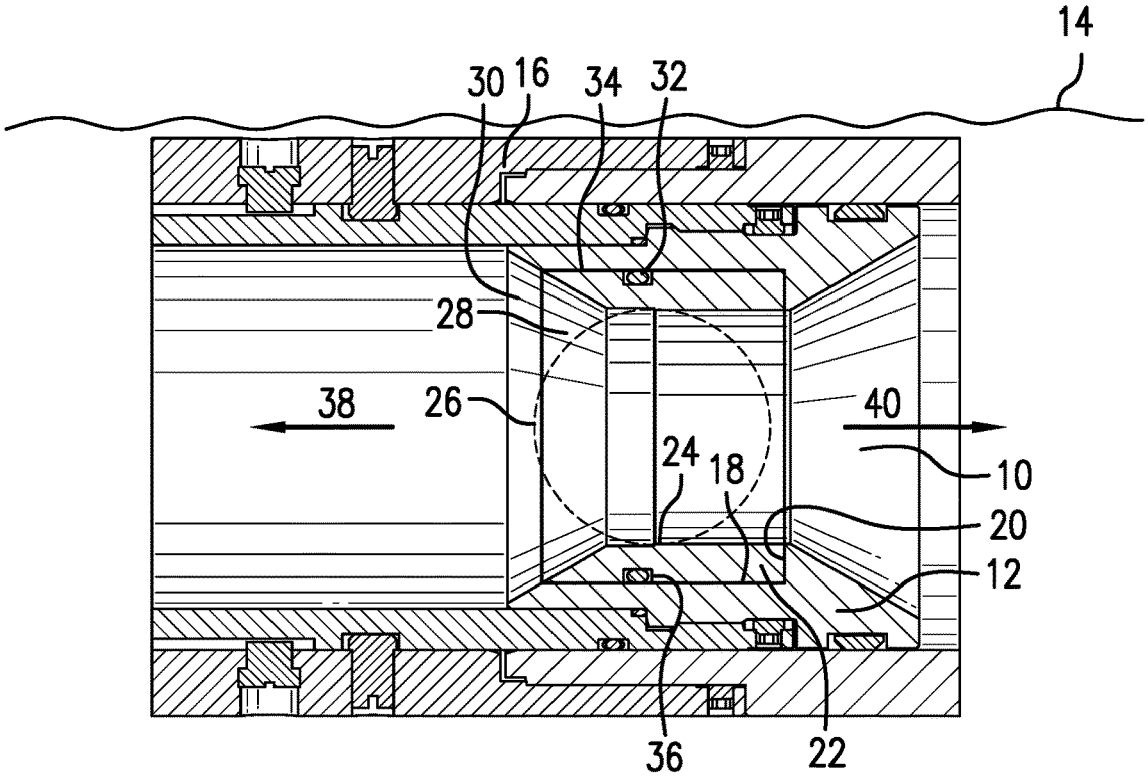
FIG. 1 is a cross sectional view of an object seat as disclosed herein.

Referring to FIG. 1 an embodiment of an object seat 10 is illustrated. The object seat 10 comprises a seat host 12 that is configured to be receivable in a borehole 14 and sometimes in a tubing string 16 that may itself be disposed in a borehole 14 (though the object seat 10 could also be employed in a tubular form that is not actually a part of a borehole, if desired). The seat host 12 should be outwardly configured to hold a position and seal against the borehole or tubing in manners similar to prior art ball seats do. Further discussion of those features is not necessary. The seat host 12 includes a seal bore 18 disposed therein and in embodiments is axially thereof. The seal bore 18 ends in a shoulder 20 in the illustrated embodiment though it is also contemplated that the seal bore 18 may extend entirely through the seat host 12. The object seat 10 further comprises a seat body 22. Seat body 22 exhibits an object receptor 24 that is configured to receive an object 26 and is shaped and dimensioned to be sealingly received in the seal bore 18. In some embodiments, the seat body 22 will include a lead in surface 28. In embodiments, this lead in surface 28 may be coextensive with a frustoconical surface 30 of the seat host 12. In embodiments where the seal bore 18 extends completely through the seat host 12 as noted above, the frustoconical surface 30 may be modified to produce a shoulder against which a radially larger section (not shown) of the seat body 22 may bear. The point is to allow the seat body 22 to hold pressure supported by the seat host 12. In the FIG. 1 embodiment, a seal 32 (such as an o-ring or similar) is disposed within a seat body and seat host interface 34. The seal 32 may be positioned within a groove 36 of the seat body 22 or may be within a groove (not shown) in the seat host 12. It is expedient to consider where a groove is placed lengthwise along interface 34. In the illustrated condition, the groove 36 is nearer an upstream end of the seat body 22. Accordingly, when the seat body 22 is expelled from the seat host 12 after an object 26 becomes stuck therein, the amount of movement needed is a lesser amount than if the groove 36 were further downstream of the seat body 22. This is because all that is needed initially for flow is for the seal 32 to exit the seal bore 18 (reference is made to FIG. 4*a* which shows the seal has exited the seal bore for one of the embodiments hereof and includes an arrow indicating fluid flow. All embodiments hereof use the same concept for allowing a flow). The seat body 22 may of course be completely expelled from the seat host 12 if desired for greater flow but for degrading purposes, all that is needed is to have some flow, which is achieved when the seal 32 leaves the seal bore 18. If the groove 36 were further downstream, more movement of the seat body 22 would be necessary before that flow would be achieved. Similarly, if a groove housing the seal 32 were on the seal host 12 side of the interface 34, it would better be placed in a more downstream position for the same reason. If the seal 32 does not move with the seat body 22, it would desirably be closer to an end of the seat body 22 so that flow will be established with less movement of the seat body 22. Also noted for this embodiment is that the only retention of the seat body 22 in the seal host 12 in an upstream direction 38 is friction of the seal 32 while in the downstream direction the seat body 22 is located by shoulder 20.

Figure 2:
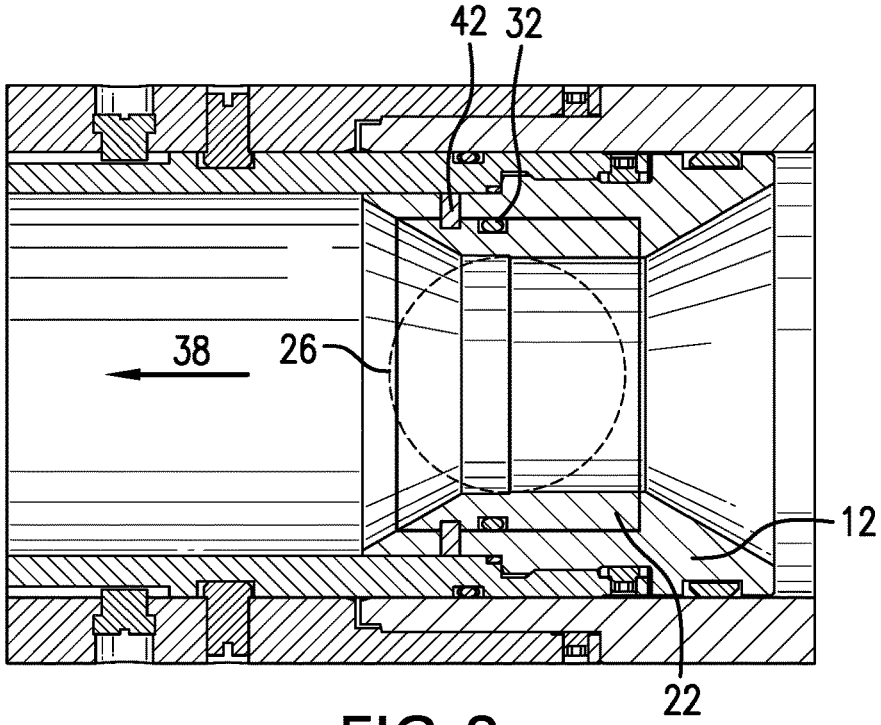
FIG. 2 is a cross sectional view of an alternate embodiment of an object seat as disclosed herein.

In another embodiment, referring to FIG. 2, the object seat 10 is modified to require a greater pressure differential to expel the seat body 22 than required by friction of the seal 32 alone in order to provide for greater confidence that the seat body 22 will not be inadvertently expelled from the seat host 12 during handling. Specifically, the object seat 10 is modified to include a release feature 42. In one embodiment the release feature 42 is a shear screw. In this embodiment, after an object is stuck and the seat body 22 must be expelled from the seat host 12 in order to reestablish flow, a pressure differential in the direction 38 must overcome both the friction presented by seal 32 and the retaining capability of the release feature 42. In other respects the embodiment works as does that of FIG. 1.

Figure 3:
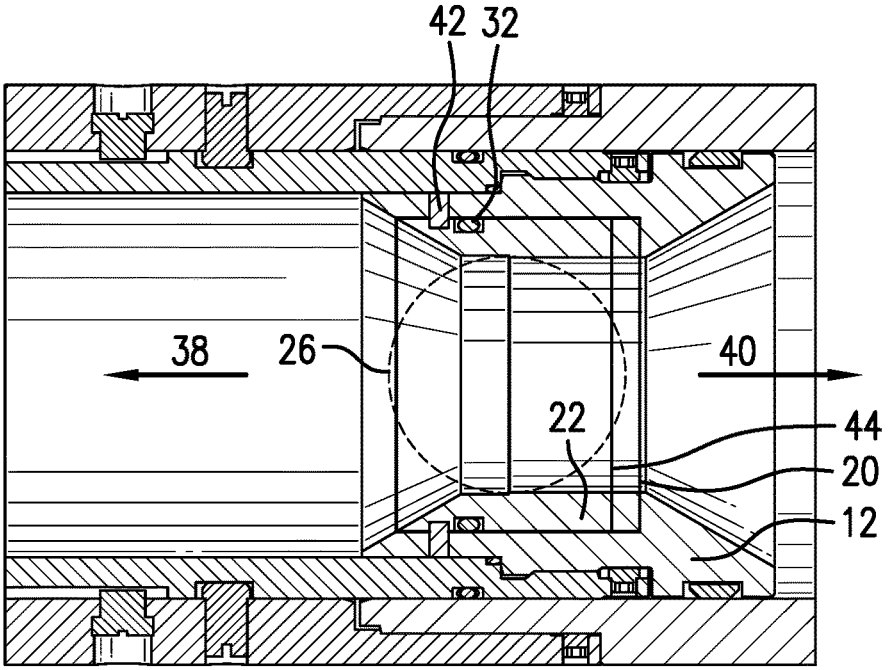
FIG. 3 is a cross sectional view of another alternate embodiment of an object seat as disclosed herein.

In yet another embodiment, referring to FIG. 3, the configuration of FIG. 2 is utilized except that it has been recognized that while there is interest in robust tools especially in the resource recovery arts, i.e. the embodiment of FIG. 2 will be well liked, there is also a possibility that the additional pressure differential required in the upstream direction 38 for FIG. 2 is undesirable for a particular operation. This is addressed in the FIG. 3 embodiment. Specifically, the seat body 22 has an end 44 that does not initially contact shoulder 20 of seat host 12. Therefore, pressure differential in the downstream direction 40 will not only be used to seat the object 26 and ultimately carry out a pressure operation but it will release the release feature 42 as well. The seat body 22 will move in the direction 40 until its end 44 abuts shoulder 20 and sufficient pressure may be built to undertake whatever operation is planned such as a fracturing operation in a hydrocarbon well. This means that the release feature 42 ensures the object seat 10 is secure during transportation and handling and yet the seat body 22 may be expelled from the seat host 12 with pressure in the direction 38 merely by overcoming friction as in FIG. 1.

Figure 4:
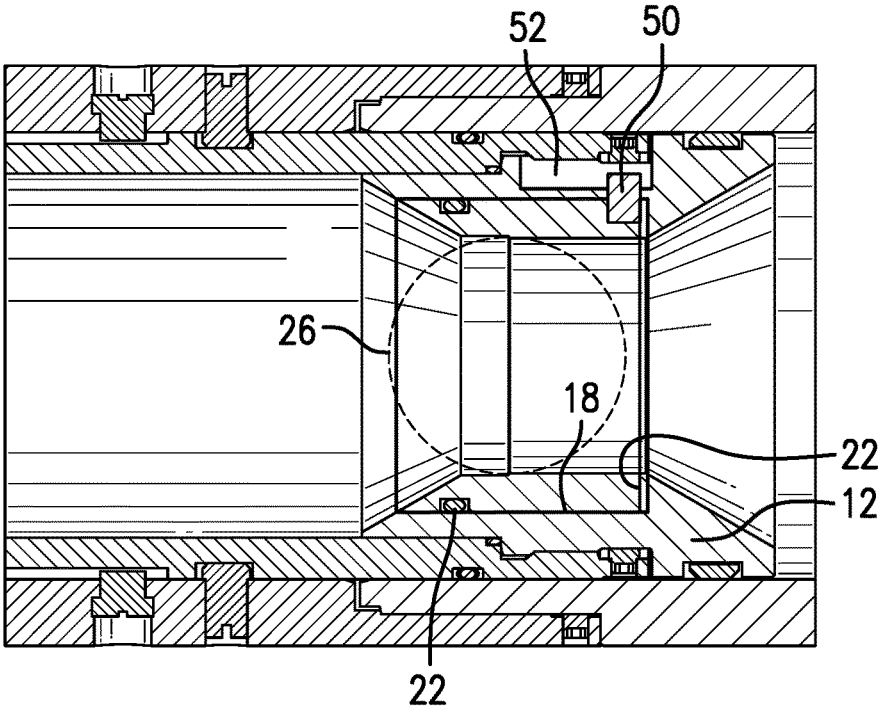
FIG. 4 is a cross sectional view of yet another alternate embodiment of an object seat as disclosed herein.
Figure 4A:
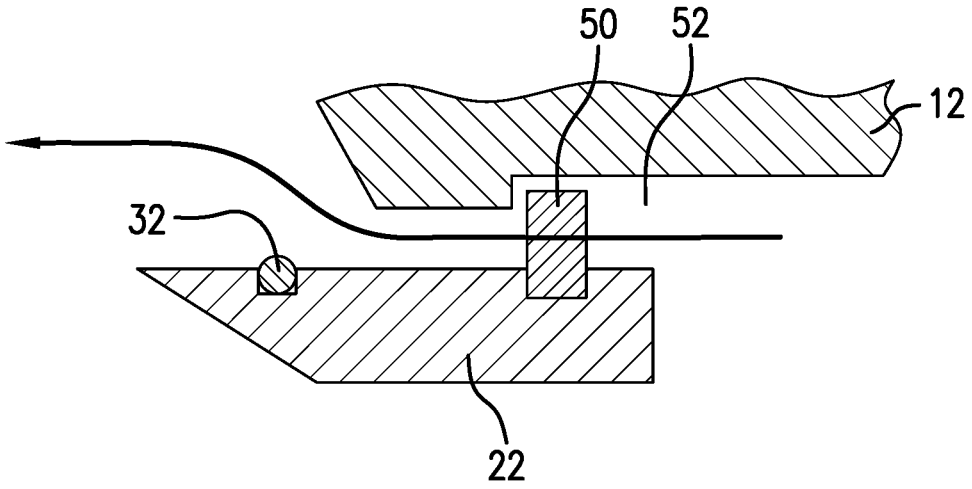
FIG. 4*a* is a cross sectional view of a portion of FIG. 4 that illustrates a flow path between the seat host and the seat body.
Figure 6:
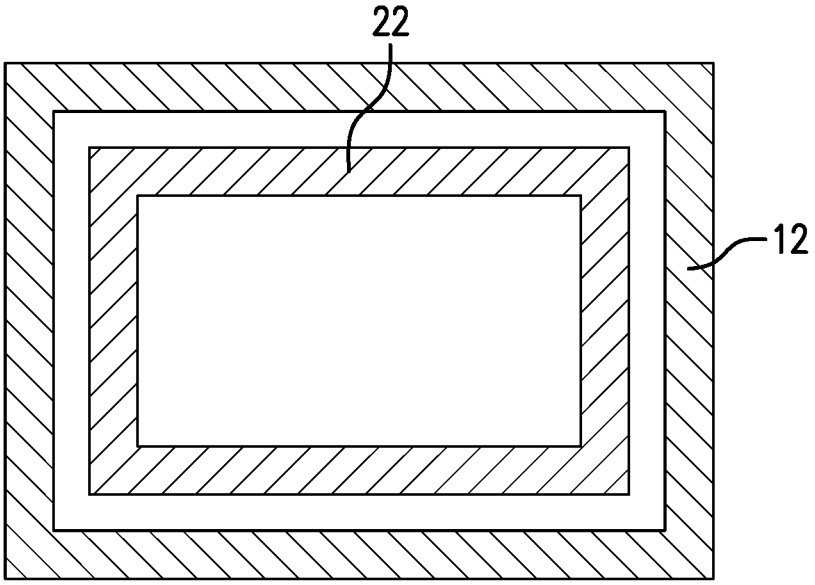
FIG. 6 is a schematic representation of a seat body and seat host that are rotationally inhibited by geometry.

In yet another embodiment, referring to FIG. 4, the concept of object seat 10 is provided with an anti-rotation configuration in order to allow for drill out if necessary. While the foregoing embodiments all perform admirably, it is often desirable to ensure that tools in a borehole are drillable in the event such action is considered necessary. In embodiments hereof where the seat body is rotatable, a drilling operation would be hindered to some degree by the seat body 22. In order to address this issue, some embodiments hereof will prevent rotation of the seat body 22 within the seat host 12. This is accomplished by rendering the cross section geometry of the seat body 22 and the seal bore 18 non circular and the same as each other (see FIG. 6), which can be imagined using any of the illustrations hereof and alternatively by employing a lug 50 concept as illustrated in FIG. 4. It can be appreciated that lug 50 bridges the seat host 12 and the seat body 22. In one of these, (seat host or seat body) will be a slot 52 to allow for axial movement of the seat body 22 relative to the seat host 12 but not for rotational movement of the seat body 22 relative to the seat host 12. In the illustration the slot 52 is in the seat body 12. The slot 52 will be at least long enough that the seat body 22 may move sufficiently to displace the seal 32 from the seal bore 18 and reestablish flow around the seat body 22.

Figure 5:
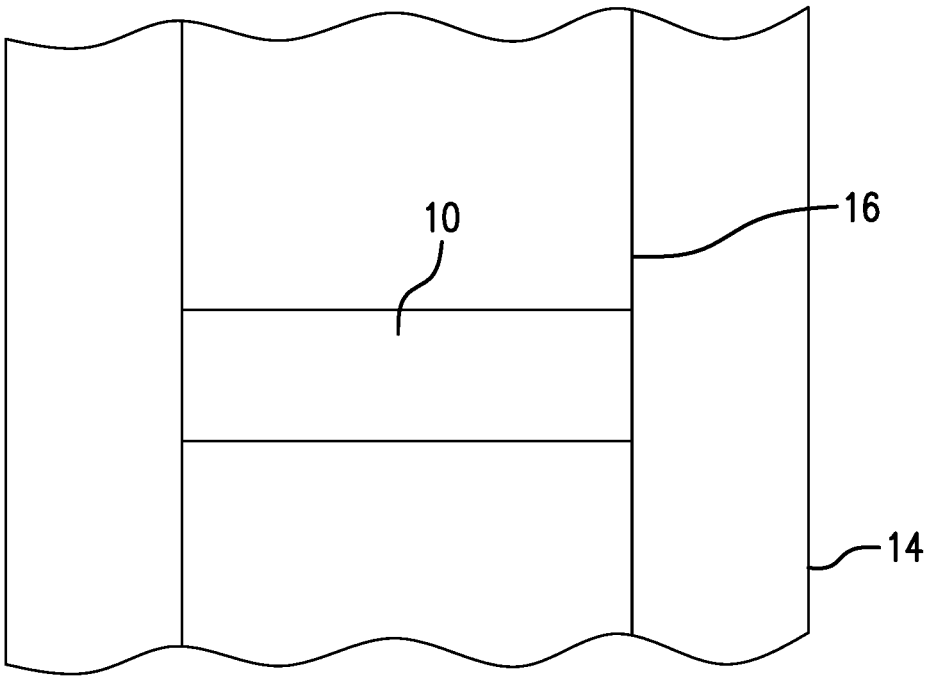
FIG. 5 is a schematic view of a borehole system including the object seat as disclosed herein.

FIG. 5 schematically illustrates the object seat 10 in a borehole of a resource bearing formation as a part of a system for recovering such resource.

Set forth below are some embodiments of the foregoing disclosure:

Embodiment 1

An object seat including a seat host having a seal bore therein, a seat body dimensioned to be receivable in the seal bore, the seat body having an object receptor.

Embodiment 2

The object seat as in any prior embodiment further comprising a seal disposed between the seat body and the seat host.

Embodiment 3

The object seat as in any prior embodiment further comprising a release feature.

Embodiment 4

The object seat as in any prior embodiment wherein the release feature is a shear member.

Embodiment 5

The object seat as in any prior embodiment further comprising a rotation inhibitor between the seat body and the seat host.

Embodiment 6

The object seat as in any prior embodiment 5 wherein the rotation inhibitor is a noncircular cross sectional geometry of the object seat.

Embodiment 7

The object seat as in any prior embodiment wherein the rotation inhibitor includes a lug.

Embodiment 8

The object seat as in any prior embodiment wherein the lug is engaged in a groove in one of the seat body or the seat host opposite one of the seat body or seat host from which the lug protrudes.

Embodiment 9

The object seat as in any prior embodiment wherein the seat body has an axial length that is shorter than an axial length of the seal bore in the seat host.

Embodiment 10

The object seat as in any prior embodiment further comprising a release member.

Embodiment 11

A method for carrying out a pressure operation in a borehole including seating an object on an object receptor of a seat body, the seat body disposed in a seat host, the seat host disposed in the borehole, pressuring against the object, and moving the seat body along an interface between the seat body and the seat host to create a fluid flow pathway through the seat body and seat host interface.

Embodiment 12

The method as in any prior embodiment wherein moving the seat body includes transitioning a seal from a position within the interface to outside of the interface.

Embodiment 13

The method as in any prior embodiment wherein the moving includes releasing a release feature.

Embodiment 14

The method as in any prior embodiment wherein the releasing is shearing a shear member.

Embodiment 15

The method as in any prior embodiment wherein the moving is in a first direction under the influence of the pressuring and is in a second direction to create the fluid flow pathway.

Embodiment 16

The method as in any prior embodiment wherein the first direction includes releasing the release feature.

Embodiment 17

The method as in any prior embodiment wherein the releasing is shearing a shear member.

Embodiment 18

The method as in any prior embodiment further comprising drilling the object seat wherein the seat body further includes a rotation inhibitor.

Embodiment 19

A borehole system including a borehole in a formation, an object seat as in any prior embodiment disposed in the borehole.

Embodiment 20

The borehole system as in any prior embodiment further comprising a tubular string disposed within the borehole, the object seat disposed in the tubular string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An object seat comprising:

a seat host having a seal bore therein;

a seat body dimensioned to be receivable in the seal bore, the seat body having an object receptor;

a seal disposed between the seat body and the seat host in a first position and in a position not between the seat body and the seat host in a second position, the first position preventing flow between the seat body and the seat host and the second position allowing flow between the seat body and the seat host; and a rotation inhibitor positioned and configured to inhibit relative rotation between the seat body and the seat host as well as to allow the seat body to move out of the seal bore enough to convey the seal out of the seal bore but retain the seat body in the seal bore.

2. The object seat as claimed in claim 1 further comprising a release feature.

3. The object seat as claimed in claim 2 wherein the release feature is a shear member.

4. The object seat as claimed in claim 1 wherein the seat body is of a noncircular cross sectional geometry.

5. The object seat as claimed in claim 1 wherein the rotation inhibitor includes a lug.

6. The object seat as claimed in claim 5 wherein the lug is engaged in a groove in one of the seat body or the seat host opposite one of the seat body or seat host from which the lug protrudes.

7. The object seat as claimed in claim 1 wherein the seat body has an axial length that is shorter than an axial length of the seal bore in the seat host.

8. The object seat as claimed in claim 7 further comprising a release member.

9. A method for carrying out a pressure operation in a borehole comprising:

seating an object on an object receptor of a seat body, the seat body disposed in a seat host, the seat host disposed in the borehole, the seat body and seat host including a rotation inhibitor to inhibit relative rotation between the seat body and the seat host and to allow axial movement of the seat body from the seat host only enough to allow a seal of the seat body to exit the seat host while retaining a balance of the seat body within the seat host;

pressuring against the object; and moving the seat body along an interface between the seat body and the seat host to cause the seal to exit the seat host and thereby create a fluid flow pathway between the seat body and seat host while retaining the balance of the seat body within the seat host.

10. The method as claimed in claim 9 wherein the moving includes releasing a release feature.

11. The method as claimed in claim 10 wherein the releasing is shearing a shear member.

12. The method as claimed in claim 10 wherein the moving is in a first direction under the influence of the pressuring and is in a second direction to create the fluid flow pathway.

13. The method as claimed in claim 12 wherein the first direction includes releasing the release feature.

14. The method as claimed in claim 13 wherein the releasing is shearing a shear member.

15. A borehole system comprising:

a borehole in a formation;

an object seat as claimed in claim 1 disposed in the borehole.

16. The borehole system as claimed in claim 15 further comprising a tubular string disposed within the borehole, the object seat disposed in the tubular string.

* * * * *